US006367710B2

(12) United States Patent
Fan

(10) Patent No.: US 6,367,710 B2
(45) Date of Patent: Apr. 9, 2002

(54) SHOWERHEAD

(76) Inventor: Chen-Yueh Fan, Room F/23, 4th Fl., No. 5, Sec. 5, Hsinyi Rd., Taipei (TW)

( * ) Notice: Subject to any disclaimer, the term of this patent is extended or adjusted under 35 U.S.C. 154(b) by 0 days.

(21) Appl. No.: 09/814,275

(22) Filed: Mar. 21, 2001

Related U.S. Application Data

(63) Continuation-in-part of application No. 09/205,059, filed on Dec. 3, 1998, now Pat. No. 6,076,743.

(51) Int. Cl.[7] ..... B05B 1/08

(52) U.S. Cl. ..... 239/99; 239/381; 239/447; 239/449; 239/548

(58) Field of Search ..... 239/548, 446, 239/447, 448, 449, 450, 381, 99, 553, 562, 552, 557, 558

(56) References Cited

U.S. PATENT DOCUMENTS 3,963,179 A * 6/1976 Tomaro ..... 239/447
5,090,624 A * 2/1992 Rogers ..... 239/381
5,433,384 A * 7/1995 Chan et al. ..... 239/449
5,765,760 A * 6/1998 Kuo ..... 239/552
6,076,743 A 6/2000 Fan

* cited by examiner

*Primary Examiner*—David A. Scherbel
*Assistant Examiner*—Dinh Q. Nguyen
(74) *Attorney, Agent, or Firm*—Dellett and Walters

(57) ABSTRACT

A showerhead has a water-exit element, a button pivotally received in the water-exit element, a moveable flapper disposed inside the water-exit element, and a water-separating plate and a nozzle cover placed in front of the moveable flapper. The button and the valve are able to control water to flow in a selected passage and create a particular type of shower jet. By adjusting the button, different kinds of shower jets can be easily selected. The controlling device, that is, the button and the moveable flapper, has a simple structure which is easy to manufacture and to repair.

12 Claims, 5 Drawing Sheets

SHOWERHEAD

This is a continuation-in-part of application Ser. No. 09/205,059 filed on Dec. 3, 1998, now U.S. Pat. No. 6,076,743 filed by the same applicant.

BACKGROUND OF THE INVENTION

1. Field of the Invention

2. Description of Related Art

The applicant filed an application bearing the number of U.S. Pat. No. 6,076,743, which relates to a button mounted on one side of a showerhead to select the desired types of water streams exiting the showerhead. The mechanism use in deriving the desired types of water streams is by blocking of a movable flapper to a first outlet or a second outlet. The flapper has an annular sealing packing retaining ring protruding on a surface of the flapper to provide a watertight seal when blocking the first outlet or the second outlet. However, the annular sealing packing retaining ring may be damaged due to long-term use because the rubbing against a surface defining the first outlet and the second outlet during operation. Furthermore, adding the annular sealing packing retaining ring onto the surface of the flapper requires a manufacturing process which is able to be further simplified.

To overcome the shortcomings, the present invention tends to provide a showerhead to mitigate or obviate the aforementioned problems.

SUMMARY OF THE INVENTION

The primary objective of the present invention is to provide a showerhead, such that the showerhead is able to spray different kinds of shower jets.

Another objective of the present invention is to provide a showerhead with a controlling device to provide different kinds of shower jets, such that the controlling device has a simple structure which is easy to manufacture and convenient to repair.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
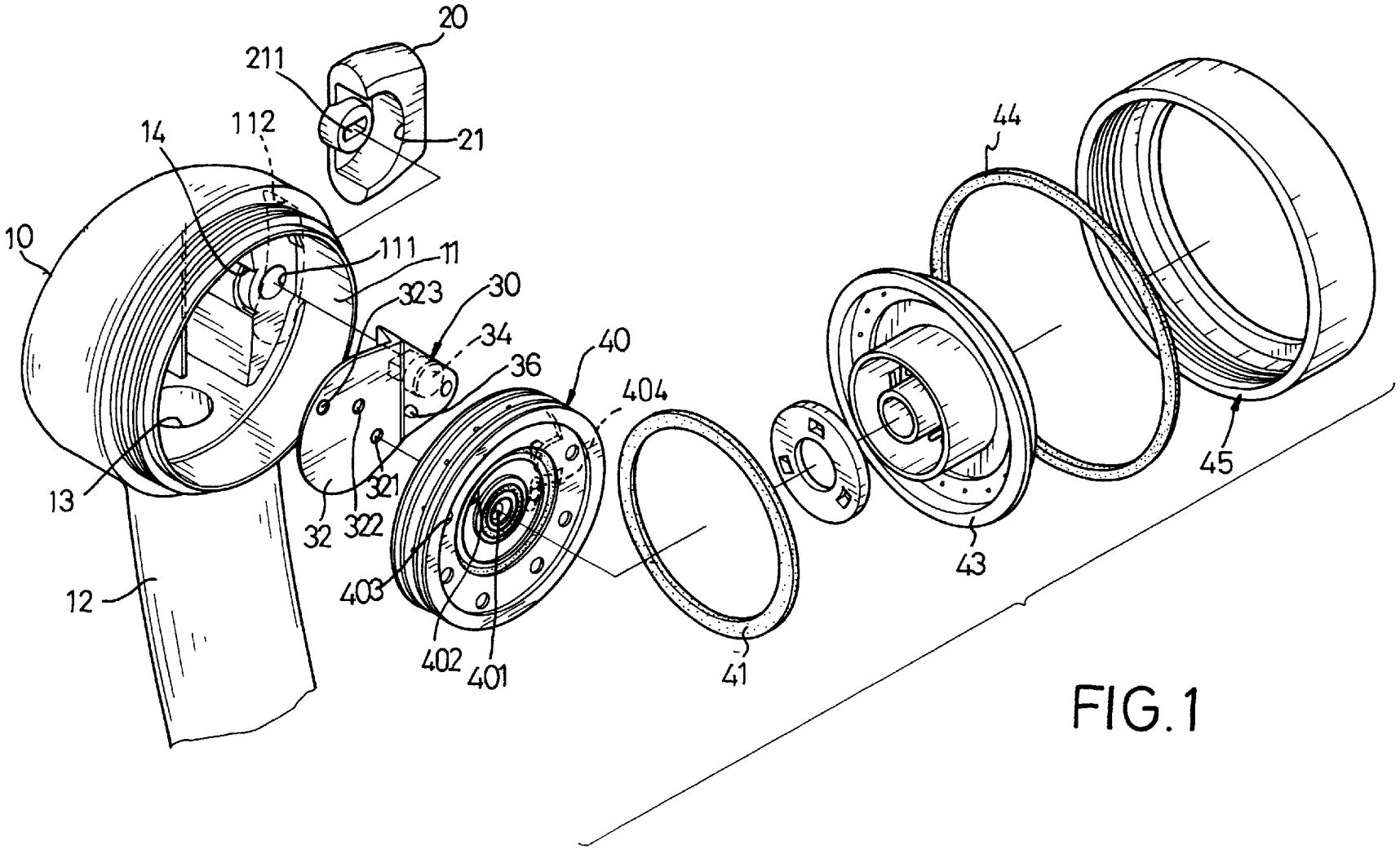
FIG. 1 is an exploded, perspective view of a showerhead in accordance with the present invention.

With reference to FIG. 1, a showerhead in accordance with the present invention includes a water-exit element (10), a button (20), a moveable flapper (30), a water-separating plate (40), a nozzle cover (43) and a retaining ring (45).

The water-exit element (10) is a hollow cylinder having a front opening (14), a handle (12) extending downward from the water-exit element (10), and a chamber (11) defined inside a periphery of the water-exit element (10). An outer threading is formed around an outer surface of a circumferential wall of the front opening (14). The handle (12) is a tube which communicates with the chamber (11) inside the water-exit element (10) by a bottom opening (13) defined in the bottom periphery of the water-exit element (10). A protrusion (14) is formed on an inner surface of the side periphery of the water-exit element (10), and a blind slot (112) extends into the protrusion (14). An opening of the slot (112) is defined in an outer surface of the side periphery of the water-exit element (10). A first through hole (111) is defined in the protrusion (14) and communicates the slot (112) and the water-exit element (10).

The button (20) has a recess (21) and a second through hole (211) defined in a bottom surface of the recess (21). The button (20) is so configured that after inserting the button (20) into the slot (112), centers of the first through hole ( 111) and the second through hole (211) are co-axial.

The moveable flapper (30) has a first aperture (321), a second aperture (322), and a third aperture (323). A peg (34) extending backward is securely formed on a distal portion of a first surface of the moveable flapper (30), and the peg (34) has two portions each portion having a configuration which corresponds to the first through hole (111) and the second hole (211), respectively. The second through hole (211) and the corresponding portion of the peg (34) are so configured that after inserting the portion of the peg (34) into the second through hole (211), a periphery of the second through hole (211) and the portion of the peg (34) are securely clamped together. A pin (36) formed on a second surface of the moveable flapper (30) and extends forward relative to the peg (34).

A water-separating plate (40) which is a circular disc has a core portion, a middle portion, and an outer portion. The core portion of the water-separating plate (40) encompasses a center of the water-separating plate (40), and the core portion has a first opening (401) to cooperate with the first aperture (321) of the moveable flapper (30). The middle portion of the water-separating plate (40) is adjacent to the core portion, and the middle portion has a second opening (402) to cooperate with the second aperture (322) of the moveable flapper (30). The outer portion is the remaining portion of the water-separating plate (40) not include by the core portion and the middle portion. The outer portion has a third opening (403) to cooperate with the third aperture (323) of the moveable flapper (30). Three recesses (404) are defined in a face of the moveable flapper (30) of the water-separating plate (40). Each of the recesses (404) is so configured that the pin (36) of the moveable flapper (30) is able to be moveably received in each of the recesses (404) and thus provide positioning between the moveable flapper (30) and the water-separating plate (40).

Remaining components of the showerhead are placed in front of the water-separating plate (40) and inside the water-exit element (10) by a sequence of a first gasket (41), the nozzle cover (43) having two concentric tubes protruding backward and multiple apertures defined in a face of the nozzle cover (43), a second gasket (44), and the retaining ring (45) with an inner thread to threadingly engage with the outer threading of water-exit element (10).

To assemble the showerhead, a portion of the button (20) with the second through hole (211) defined therein is placed into the slot (112). By extending the peg (34) of the moveable flapper (30) through the first through hole (111) and the second through hole (211), the button (20) and the moveable flapper (30) are securely connected together and attached to the water-exit element (10). The first gasket (41) is attached around the water-separating plate (40). The water-separating plate (40) and the gasket (41) are inserted into the water-exit element (10) and placed in front of the moveable flapper (30). The nozzle cover (43) is then inserted into the water-exit element (10). The second gasket (44) is put around the outer circumferential wall of the water-exit element (10) to form a watertight seal. Finally, the retaining ring (45) is tightly screwed onto the water-exit element (10).

Figure 2A:
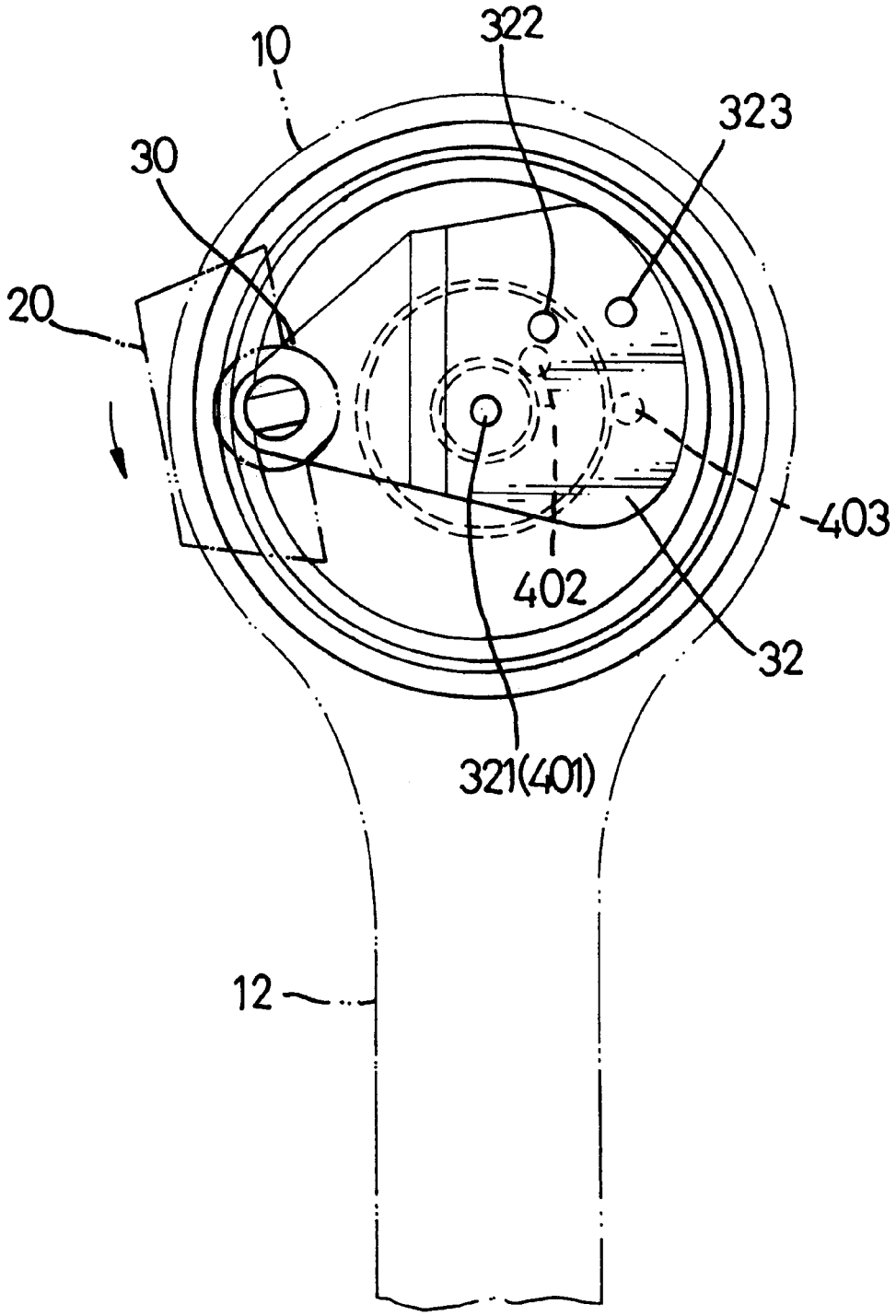
FIG. 2A is an operational cross-sectional view of the showerhead when a button is at a first position.

With reference to FIG. 2A, when operating under a first condition, the button (20) is adjusted by a user to move the moveable flapper (30) by the connection of the peg (34), so that the first aperture (321) communicates with the first opening (401). Water enters the showerhead from the handle (12) and flows into the water-exit element (10) through the bottom opening (13). The water continues to flow through the first aperture (321), the first opening (401), and into a corresponding portion of the nozzle cover (43). The water flows out of the showerhead through the apertures of the nozzle cover (43) in a particular type of shower jet, due to a particular configuration and formation of the apertures of the nozzle cover (43).

Figure 2B:
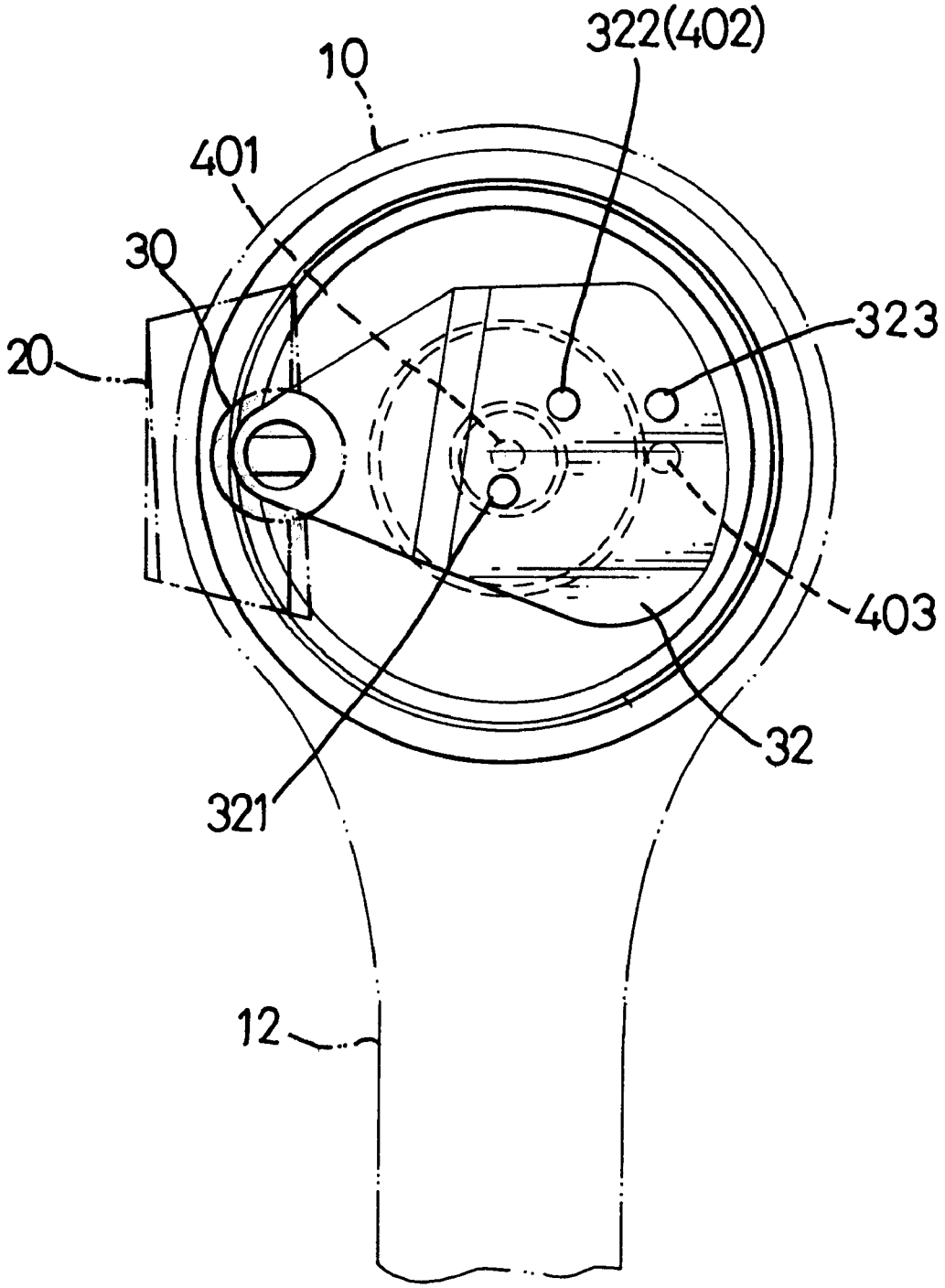
FIG. 2B is an operational cross-sectional view of the showerhead when the button is at a second position.

With reference to FIG. 2B, when operating under a second condition, the button (20) is adjusted by the user to move the moveable flapper (30) by the connection of the peg (34), so that the second aperture (322) communicates with the second opening (402). Water enters the showerhead from the handle (12) and flows into the water-exit element (10) through the bottom opening (13). The water continues to flow through the second aperture (322), the second opening (402), and into a corresponding portion of the nozzle cover (43). The water flows out of the showerhead through the apertures of the nozzle cover (43) in a particular type of shower jet, due to a particular configuration and formation of the apertures of the nozzle cover(43).

Figure 2C:
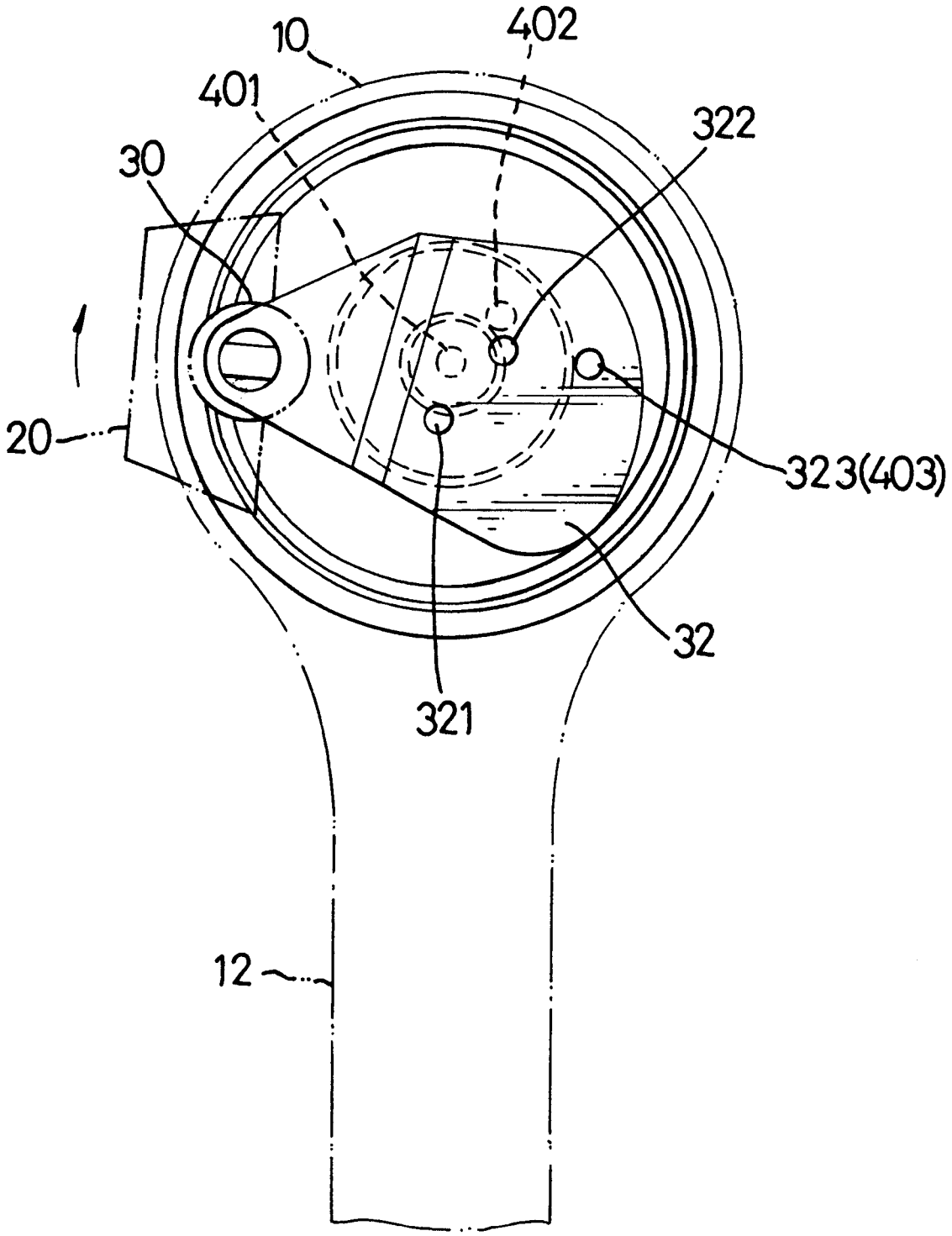
FIG. 2C is an operational cross-sectional view of the showerhead when the button is at a third position.

With reference to FIG. 2C, when operating under a third condition, the button (20) is adjusted by the user to move the moveable flapper (30) by the connection of the peg (34), so that the third aperture (323) communicates with the third opening (403). Water enters the showerhead from the handle (12) and flows into the water-exit element (10) through the bottom opening (13). The water continues to flow through the third aperture (323), the third opening (403), and into a corresponding portion of the nozzle cover (43). The water flows out of the showerhead through the apertures of the nozzle cover (43) in a particular type of shower jet due to the particular configuration of the apertures of the nozzle cover (43).

Figure 3:
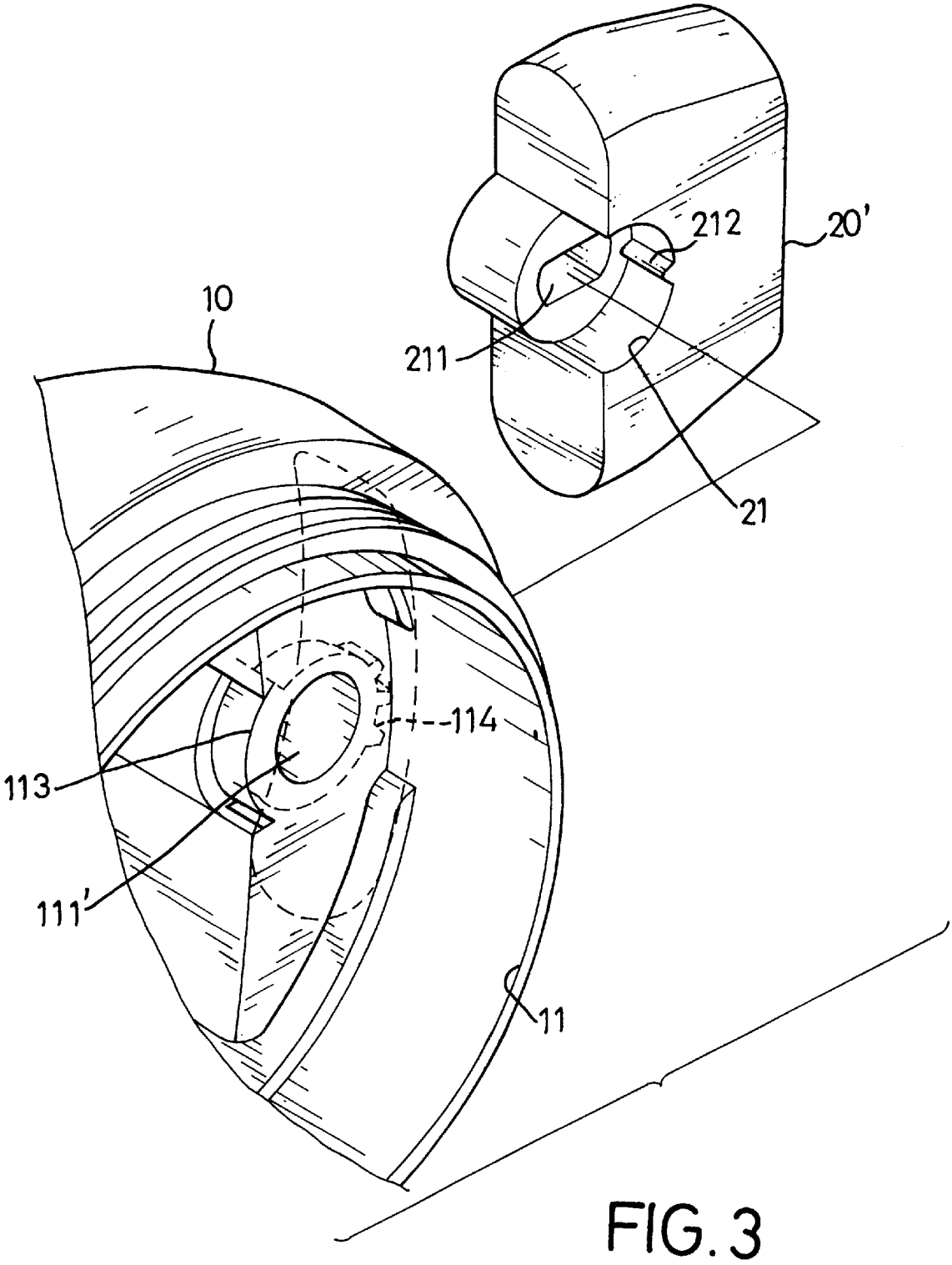
FIG. 3 is an enlarged, exploded, perspective view of another preferred embodiment.

With reference to FIG. 3, another preferred embodiment is shown. A positioning protrusion (212) is formed on a periphery of the recess (21) of the button (20') to replace the pin (36) of the first embodiment. Teeth (114) are formed on an outer circumferential wall of the first through hole (111') to replace the three recesses (404) of the first embodiment. The positioning protrusion (212) and the teeth (114) together are able to provide positioning for the moveable flapper (30), so that the apertures (321,322,323) of the moveable flapper (30) are able to communicate with the corresponding openings (401,402, and 403) by adjusting the button (20). The remainder of the components of the showerhead are unchanged from the first embodiment.

From the above description, it is noted that the invention has the following advantages:

1. versatility. Different types of shower jets can be produced due to different configurations and formations of the apertures of the nozzle cover.
2. ease of use. To choose different types of shower jets, the button is simply adjusted.
3. easy manufacturing. The button and the moveable flapper together foam a controlling device of the showerhead which has a simple structure which is easily manufactured.
4. easy repairing. The button and the moveable flapper are easily repaired or replaced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A showerhead comprising:

a water-exit element with a chamber defined in the water-exit element;

a hollow handle extending downward from the water-exit element, wherein the handle communicates with the chamber through a bottom opening defined in the water-exit element;

a button pivotally received in the water-exit element;

a moveable flapper located inside the chamber to engage with the button and multiple apertures defined in the moveable flapper, wherein the button and the moveable flapper are connected together; a water-separating plate placed inside the chamber and in front of the moveable flapper, and the moveable flapper having multiple portions, each of the portions having at least one opening, wherein each of the portions corresponds to one of the apertures;

a nozzle cover which is able to create different kinds of shower jets; and a retaining ring attaching the nozzle cover to a front opening of the water-exit element;

whereby when adjusting the button, each of the apertures is able to sequentially communicate with the corresponding opening of the portion, and different kinds of shower jets are able to be created by water flowing through different passages in water-exit element.

2. The showerhead as claimed in claim 1, wherein a pin is formed on the moveable flapper and multiple recesses are defined in the water-separating plate, and the pin is able to be moveably received in each of the recesses, so the pin and the recesses together are able to provide positioning for the moveable flapper, thus each aperture of the moveable flapper is able to sequentially communicate with the corresponding opening by adjusting the button.

3. The showerhead as claimed in claim 2, wherein the nozzle cover has concentric tubes protruding toward the water-separating plate, such that the water flowing from the different portions of the water-separating plate is able to flow into the corresponding passage.

4. The showerhead as claimed in claim 3, wherein a first gasket is disposed around the water-separating plate to provide a watertight seal.

5. The showerhead as claimed in claim 4, wherein a second gasket is disposed around the water-exit element to provide a watertight seal.

6. The showerhead as claimed in claim 5, wherein the switch and the moveable flapper are connected by a peg.

7. The showerhead as claimed in claim 1, wherein the switch and the moveable flapper are connected by a peg.

8. The showerhead as claimed in claim 1, wherein a positioning protrusion is formed on the button, and teeth are formed on a protrusion of the water-exit element, and the positioning protrusion and the gears together are able to provide positioning for the moveable flapper, so each of the apertures of the moveable flapper is able to sequentially communicate with the corresponding opening by adjusting the button.

9. The showerhead as claimed in claim 8, wherein the nozzle cover has concentric tubes protruding toward the water-separating plate, such that the water from the different portions of the water-separating plate is able to flow in to the corresponding passage.

10. The showerhead as claimed in claim 9, wherein a first gasket is put around the water-separating plate to provide a watertight seal.

11. The showerhead as claimed in claim 10, wherein a second gasket is put around the water-exit element to provide a watertight seal.

12. The showerhead as claimed in claim 11, wherein the switch and the moveable flapper are connected by a peg.

* * * * *